US007201524B2

(12) United States Patent
Jones et al.

(10) Patent No.: US 7,201,524 B2
(45) Date of Patent: Apr. 10, 2007

(54) MEDIA PATH DIRECTION CONTROL DEVICE AND METHOD OF REVERSING A MEDIA PATH

(75) Inventors: Brent R. Jones, Tualatin, OR (US); Keng Leong Ng, Singapore (SG); Joshua K. Hoyt, Portland, OR (US); Yin Mei Sia, Singapore (SG); Aaron T. Nelson, West Linn, OR (US); Thomas R. Edney, Tualatin, OR (US); Scott J. Korn, Portland, OR (US); Boon Hang Ng, Singapore (SG)

(73) Assignee: Xerox Corporation, Stamford, CT (US)

( * ) Notice: Subject to any disclaimer, the term of this patent is extended or adjusted under 35 U.S.C. 154(b) by 275 days.

(21) Appl. No.: 11/044,042

(22) Filed: Jan. 28, 2005

(65) Prior Publication Data

US 2006/0170748 A1 Aug. 3, 2006

(51) Int. Cl.

| | |
|---|---|
| ***B41J 13/10*** | (2006.01) |
| ***B41J 13/02*** | (2006.01) |
| ***B41J 13/03*** | (2006.01) |
| ***B65H 29/20*** | (2006.01) |
| *B65H 29/22* | (2006.01) |

(52) U.S. Cl. ..... 400/636; 400/578; 271/184; 271/185

(58) Field of Classification Search ..... None
See application file for complete search history.

(56) References Cited

U.S. PATENT DOCUMENTS

| | | | | |
|---|---|---|---|---|
| 3,983,988 | A | 10/1976 | Maxted et al. | |
| 5,207,412 | A | 5/1993 | Coons, Jr. | |
| 5,234,210 | A | 8/1993 | Olexy | |
| 5,234,211 | A | 8/1993 | Olexy | |
| 5,692,747 | A * | 12/1997 | Guerrero et al. | 271/296 |
| 6,149,324 | A * | 11/2000 | Song | 400/188 |
| 6,250,754 | B1 * | 6/2001 | Bortolotti | 347/104 |
| 6,369,878 | B1 | 4/2002 | Zevin et al. | |
| 6,487,382 | B2 | 11/2002 | Underwood et al. | |
| 6,705,786 | B2 * | 3/2004 | Trovinger | 400/645.3 |
| 2003/0118388 | A1 * | 6/2003 | Sampson et al. | 400/579 |

FOREIGN PATENT DOCUMENTS

DE 4417770 A1 * 11/1995

* cited by examiner

*Primary Examiner*—Daniel J. Colilla
(74) *Attorney, Agent, or Firm*—Oliff & Berridge, PLC

(57) ABSTRACT

A media path control device has two sets of parallel arms with opposing rollers to manipulate the movement of print media. The arms are moveable in a substantially vertical plane through motors. The arms can be of different lengths to establish an optimal trajectory or height of the media to change the trajectory or travel path of the media. The rollers are reversible to change the trajectory or travel path of the media. Rotation of the arms may be stopped at various points along their travel arc to position the media at a desired or plane.

22 Claims, 10 Drawing Sheets

MEDIA PATH DIRECTION CONTROL DEVICE AND METHOD OF REVERSING A MEDIA PATH

BACKGROUND

The subject matter of this application relates to print path control in an image formation device, and more specifically enables control of media travel plane, direction, and trajectory change, of media with minimal roller contact and stress on the media and an image formed on the media.

Paper path motion control in image formation devices, such as printers and copiers, typically provide media movement in an "in-line" fashion. Such devices typically employ diverters to provide an angle change when the media is to be transported to a different plane, such as in image formation devices having multiple bins and/or an alternative duplex or exit path.

For example, U.S. Pat. No. 6,487,382 discloses an in-line path of media travel wherein media travels over a plurality of rollers and diverters from a paper supply tray to an exit tray.

The disadvantage of such paper path control systems is that the media, and the image formed on the media, is often in intimate contact with multiple rollers and guides. The rollers and guides impart impressions in the media and potentially degrade the quality of the image due to rubbing contact. As a consequence, additional problems can occur as ink debris collects on and is later transferred from the various roller and guide elements to subsequent prints. Opportunities for stubbing, folding and tearing of the media increase as the number of components contacting the media increases, leading to paper jam reliability problems.

SUMMARY

The subject matter of this application addresses constraints imposed by existing image formation device architectures that require a media path direction reversal and/or movement of media to a different plane. The subject matter of this application also provides devices and methods that are capable of at least elevating and reversing the exit path of the media above an initial trajectory plane.

In known devices, making such a transition would typically require multiple sets of rollers, at least one diverter, and guides that coax the media into a new exit plane. Each of these elements contribute to the degradation of the media and the image quality and increase the difficulty of removing media jams from the image formation device.

An additional feature of the subject matter of this application provides devices and methods for a printer duplex path in which media is not adversely affected as it passes into, and then out of, the media path direction control elements in an image formation device. The subject matter of this application further provides a direction control system that is "invisible" to the normal duplex function so that image and media degradation by contact with media handling components is minimized.

The exemplary embodiment of the media path direction control elements are described as oriented in a chiefly horizontal media path where direction reversal is referenced to the horizontal and offsets are referenced as vertical translations from that horizontal path. This mechanism could just be easily be oriented to function at different angles, such as with a vertical paper path where direction reversal would be in a vertical direction and translation would be an offset from that vertical path.

DETAILED DESCRIPTION OF PREFERRED EMBODIMENTS

Figure 1:
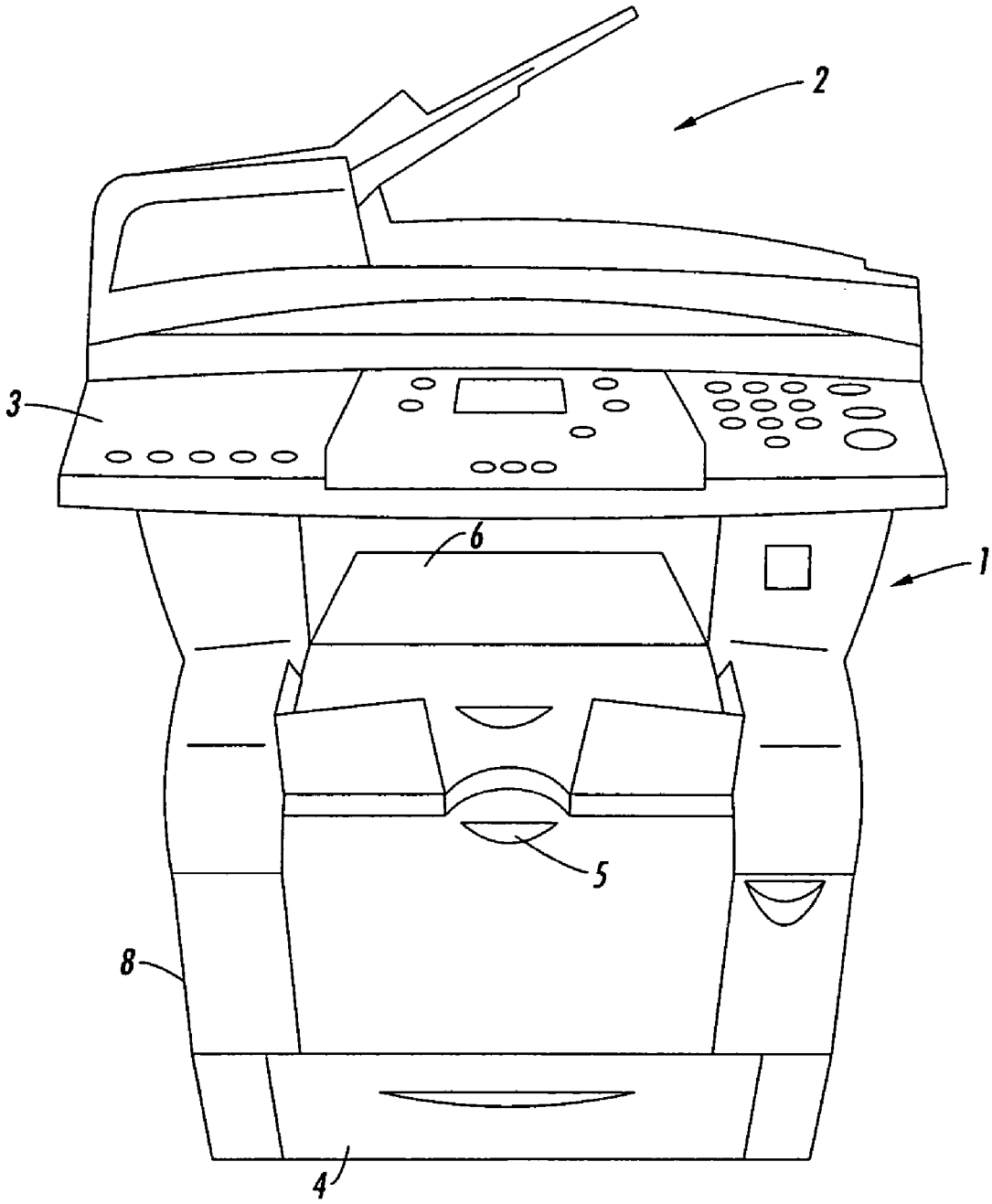
FIG. 1 shows a front view of an image formation device including an exemplary media path direction control device.
Figure 2:
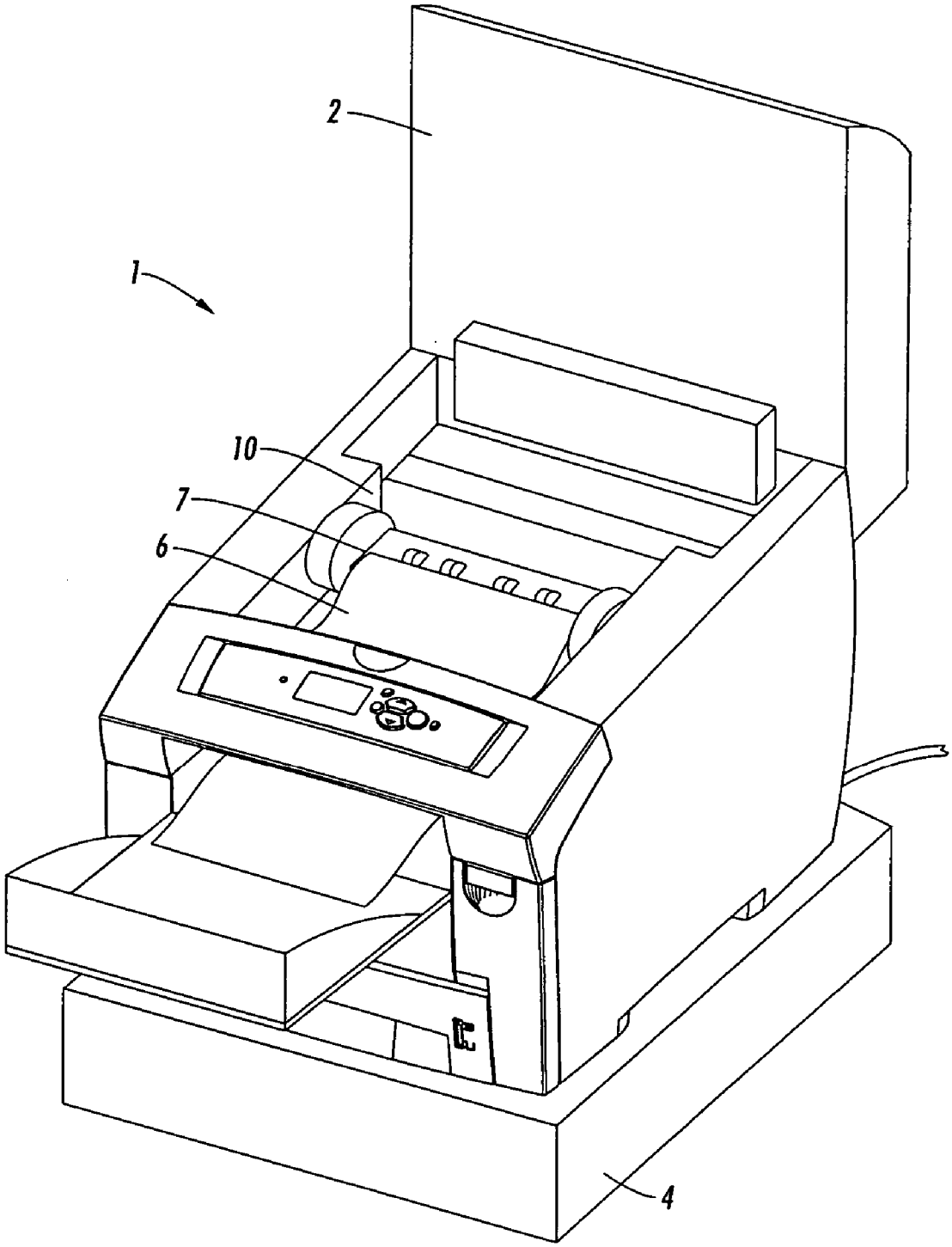
FIG. 2 shows a partial side view of the device of FIG. 1, having the scanner/lid in an open position.
Figure 3:
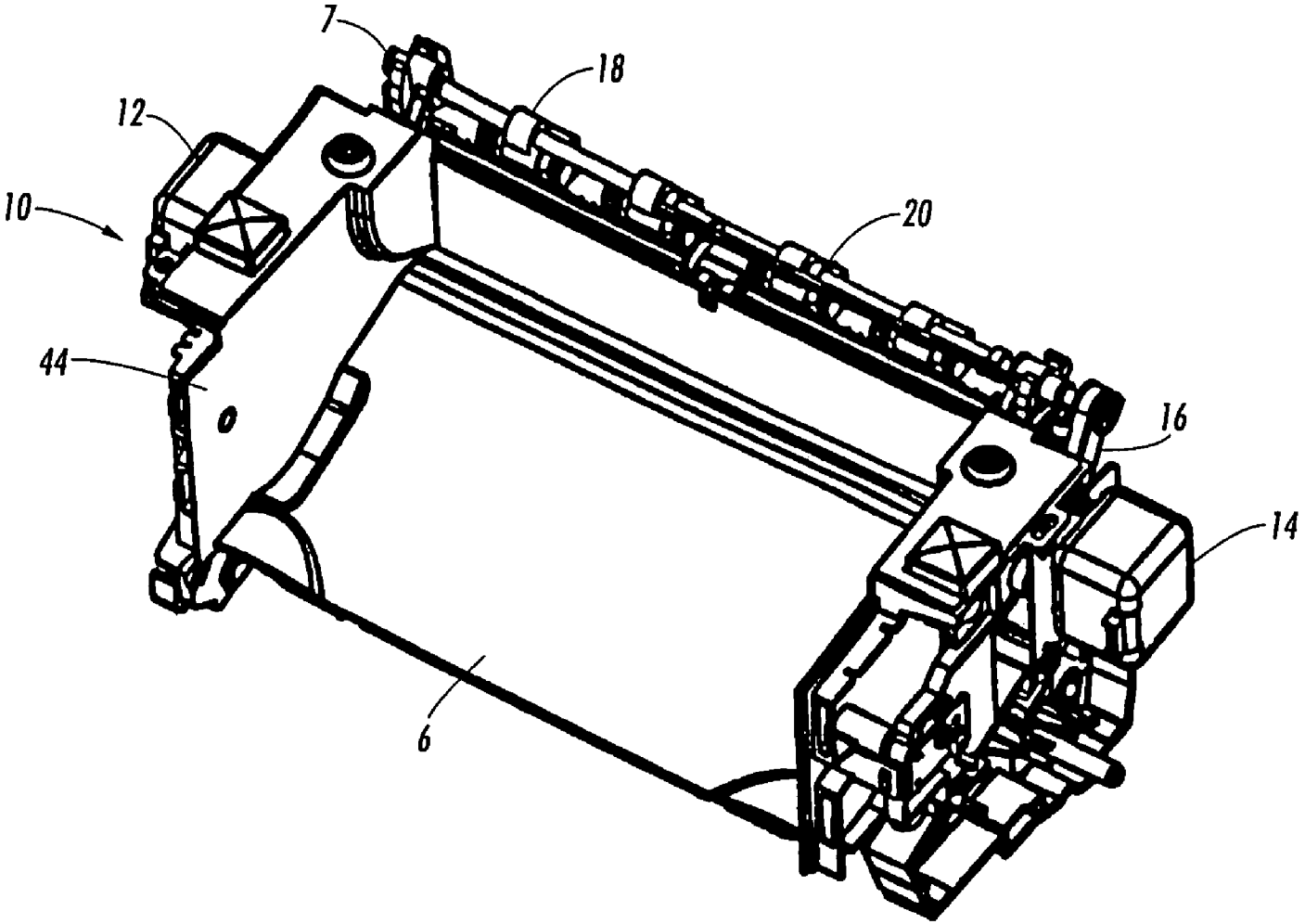
FIG. 3 shows a perspective view of an exemplary embodiment of the media path direction control device.

FIGS. 1 and 2 show an image formation device including an exemplary embodiment of a media path direction control device as shown in FIG. 3.

As shown in FIG. 1, an image formation device 1 includes a scanner/document feeder assembly 2, later simply described as a scanner, a control panel 3, and a print engine 8. The image formation device 1 generally includes a standard paper tray 4 and possibly one or two optional extra paper trays (not shown) disposed below the print engine 8. In the image formation device 1, print media is stored within the body of the image formation device for use by the print engine 8. Upon completion of printing, print media will exit the print engine to the paper exit tray 6 in front of the media path direction control device 10 (FIG. 3). The image formation device 1 may also include a multipurpose tray 5 as often found in image formation devices, shown in the non-functional closed position in FIG. 1.

FIG. 2 shows a partial side view of the image formation device 1 of FIG. 1 having the scanner 2 in an open position. As shown in FIG. 2, with the scanner 2 in the open position, a carriage 7 of the media path direction control device 10 is visible. In normal use, the scanner would be raised as shown to relieve media jams in this area and to replenish print engine ink or toner.

FIG. 3 shows a perspective view of an exemplary embodiment of the media path direction control device 10. As shown in FIG. 3, the media path direction control device 10 includes a paper exit tray 6 which receives print media exiting from the print engine 8 (not shown). An elevator motor 12 is connected to a carriage 7 via a belt 16 (not shown) to alter a vertical position of the carriage 7 to a plurality of positions. A drive motor 14 is connected to the carriage 7 via a belt 16 to drive a plurality of drive rollers 18 to manipulate media through the media path direction control device 10. In an exemplary embodiment, the elevator motor 12 and the drive motor 14 are reversible motors so as to reverse a direction of travel of the mechanism and media. A plurality of idler rollers 20 are disposed on the carriage 7 at a position opposite the drive rollers 18. A nip 46 is formed between the idler rollers 20 and the drive rollers 18 so as to capture and manipulate the movement of media through the media path direction control device 10. Although this exemplary embodiment describes a carriage, other devices, such a shaft, rod, shelf, or the like, are contemplated and are within the scope of the subject matter of this application.

Figure 4:
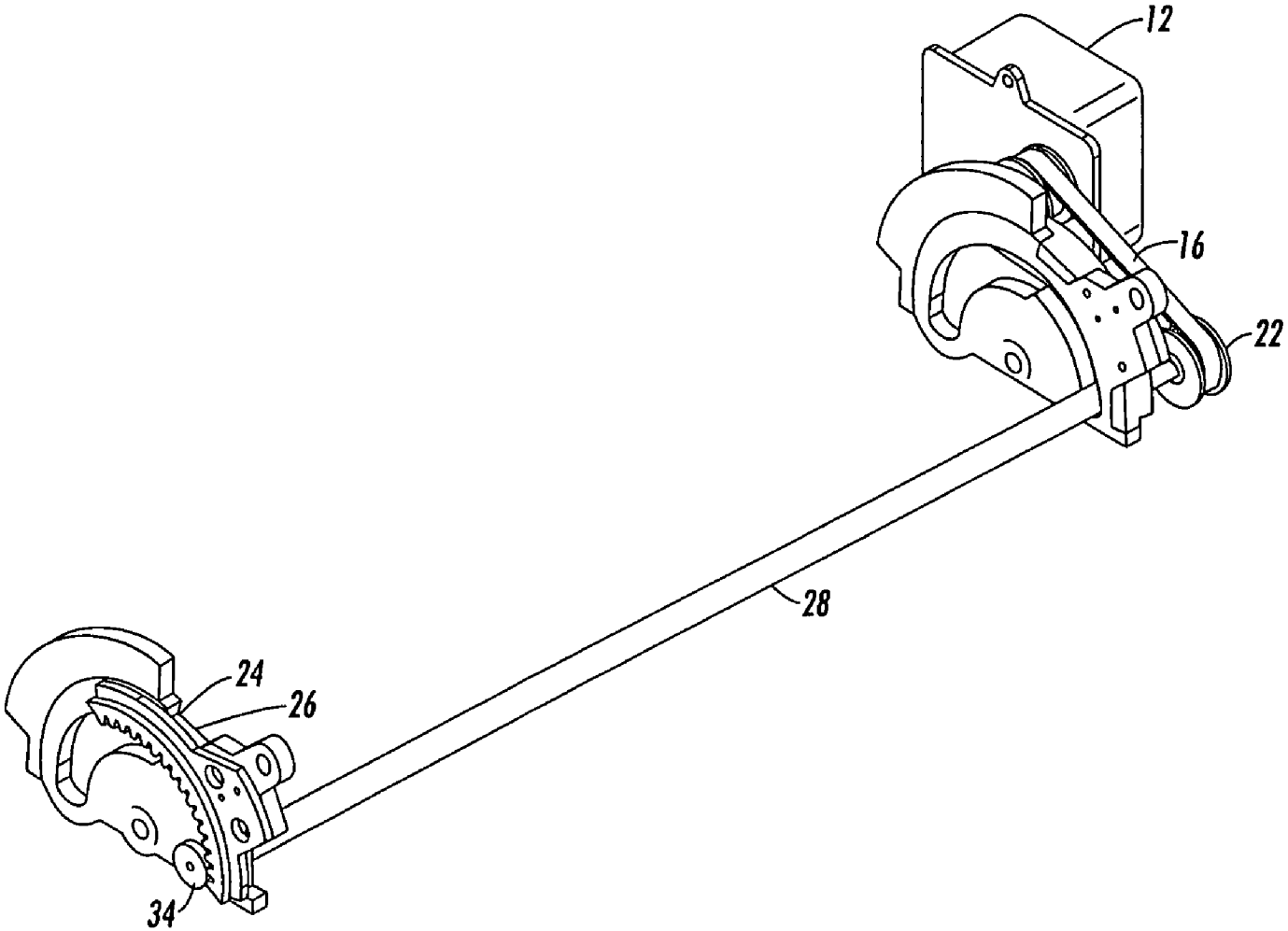
FIG. 4 shows a perspective view of a lower arm assembly of the device of FIG. 3.
Figure 5:
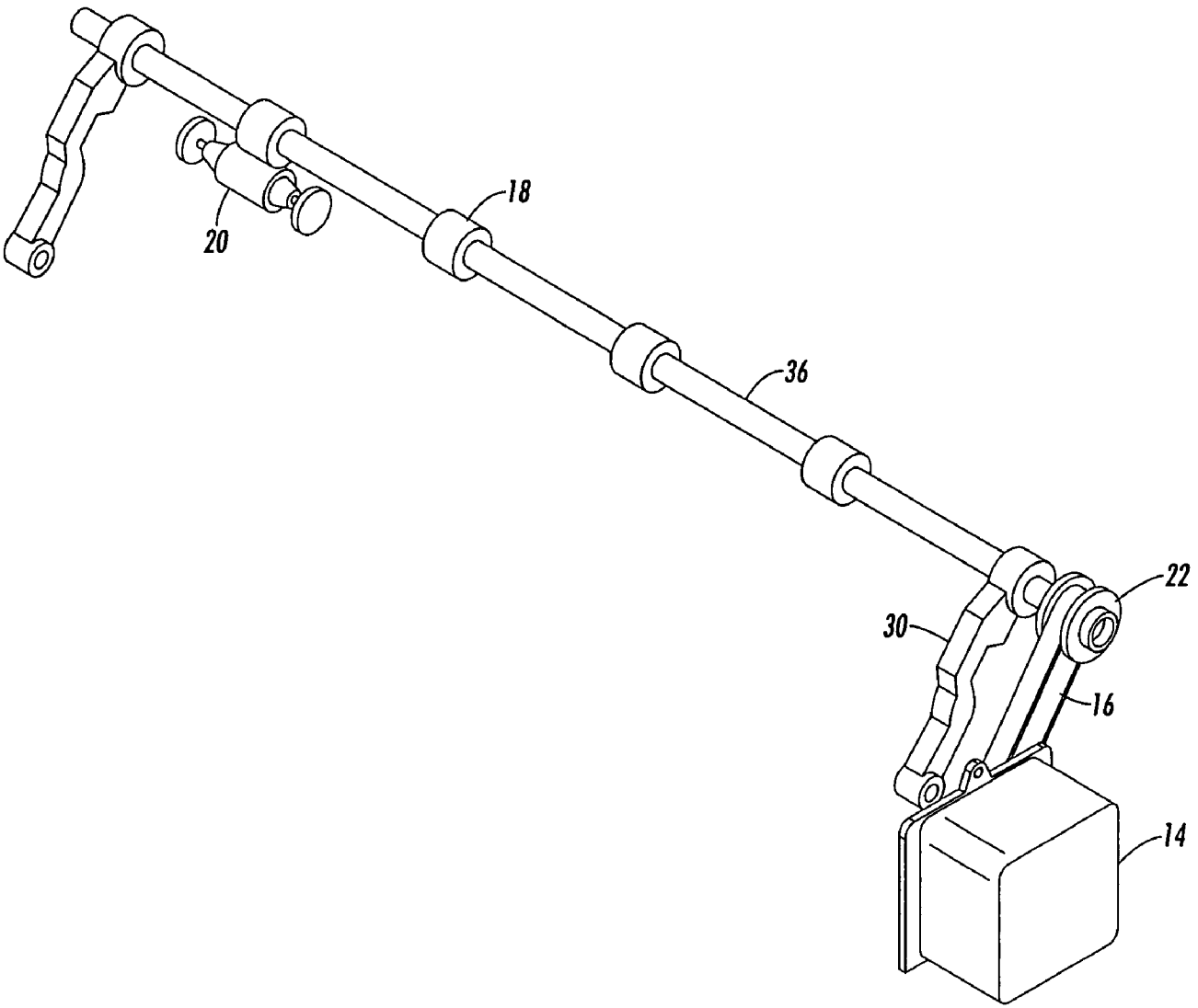
FIG. 5 shows a perspective view of an upper arm assembly of the device of FIG. 3.

FIGS. 4 and 5 show perspective views of a lower arm assembly and an upper arm assembly of the media path direction control device shown in FIG. 3.

As shown in FIG. 4, the elevator motor 12 is connected to a first pair of parallel arms 26 having an arcuate shape. Each of the arms 26 are pivotably attached to the chassis 44 of the device 10 at a pivot point 38. Each of the arms 26 is also attached or coupled to the carriage 7 (not shown). The arms could be bar shaped, appear as a plate, have numerous other features integrated into them, such as a gear rack, or could be of a variety of shapes or configurations. For simplicity, the general term arm will be used, and lower and upper to distinguish between the two sets. An elevator motor 12 is connected to a stationary drive shaft 28 via a belt 16. The belt 16 is hung around a first pulley 22 connected to the elevator motor 12 and to a second pulley 22 disposed on an end of the lower arm assembly drive shaft 28. The drive shaft 28 is disposed between the pair of parallel lower arms 26. An internal gear rack 24 formed on each of the arms 26 is driven by drive gears 34 disposed near the ends of the drive shaft 28. When the elevator motor 12 rotates the drive gear 34 via the pulleys 22 and the belt 16, the drive gear 34 rotates thereby driving the gear rack 24 to rotate the lower arms 26 about the pivot point 48. When the arm 26 is driven, the gear rack 24 is moveable along a reversible path. The drive shaft 28 distributes a drive force to drive gears disposed at the ends of the drive shaft 28 to cooperatively drive the pair of parallel lower arms 26 thereby rotating the carriage 7 primarily vertically.

FIG. 5 shows a perspective view of an upper arm assembly. A drive motor 14 having a first pulley 22 connected thereto, drives a plurality of drive rollers 18 disposed on an upper arm assembly roller shaft 36. A drive force from the drive motor 14 is imparted to the drive rollers 18 via a belt 16 connected to the first pulley 22 of the drive motor 14, and to a second pulley 22 disposed at an end of the upper arm assembly roller shaft 36. A pair of parallel upper arms 30 is disposed at opposite ends of the upper arm assembly roller shaft 36. The arms 30 are connected at a first end to opposite ends of the roller shaft 36. An opposite end of the arms 30 is connected to the chassis 44 of the device 10 at a pivot point 48. The upper arm assembly roller shaft 36 is coupled to the primarily vertically movable carriage 7. Thus, as the parallel lower arms 26 are driven by the elevator motor 12 to move the entire carriage assembly 7 in a vertical direction, the upper arm assembly roller shaft 36 and the pair of parallel upper arms 30, are cooperatively moved with the carriage 7 as a unit.

Figure 6A:
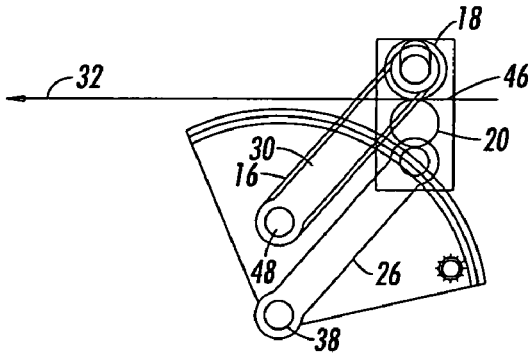
FIG. 6 shows a schematic representation of relative arm position during media transport.
Figure 6B:
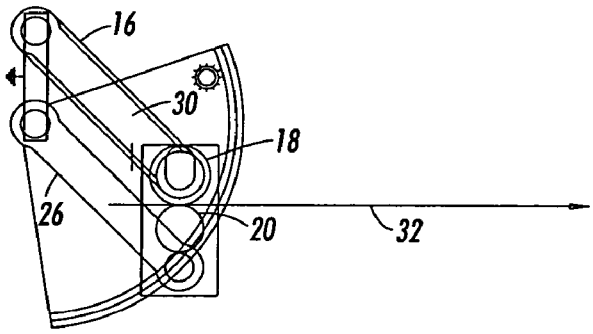
Figure 6C:
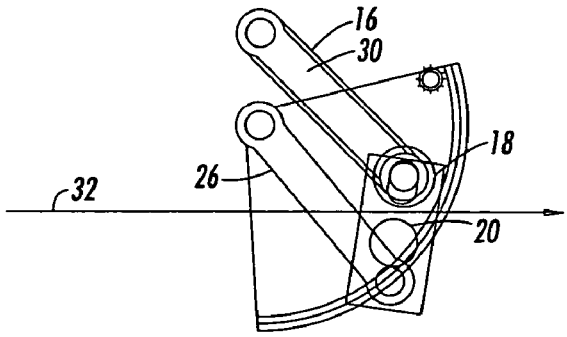

FIG. 6 shows a schematic representation of relative arm position during media transport. In an exemplary embodiment, the subject matter of this application employs, among other things, a single roller set mounted to two sets of parallel pivot arms 26, 30 sized such that media transport along a tangent vector between the rollers 18, 20 is angularly optimized to a desired media exit trajectory. For example, as shown in FIG. 6, with the parallel arms 26, 30 at a first position (Position One), the roller set accepts media traveling in a first direction, indicated by the arrow, and allows the media to travel to a point near a trailing edge of the media. Then, by pivoting the two parallel arms to a second position (Position Two), enables the media to be directed to a different path. In FIG. 6, the media is directed in a direction opposite to the first direction indicated by the arrow.

An advantage of supporting each roller 18, 20 on a separate arm is that travel of one arm 30 and the drive roller 18 can be stopped at a position to receive the media 32 and the other arm 26 and the idler roller 20 can be driven to a third position (Position Three) that creates a gap between rollers 18, 20 of the roller set, allowing the print engine 8 to perform a duplex print operation, or other media motion, without significant interaction with the direction control device 10. The gap between rollers 18, 20 in the media path direction control device 10 at Position three significantly reduces concern for differences in roller speed and media transport velocity between the print engine 8 and the media path direction control device 10. Controlling the motion profile of the pivot arms 26, 30 from Position Three to Position One allows the media 32 to be clamped within the exit roller set of the print engine in a benign fashion so that the image and media are minimally affected by the operation.

In an exemplary embodiment, the device 10 has no diverter, no media guides and only a single roller set, thereby ensuring that the direction and transport path change have minimal influence on the media 32 and an image formed thereon.

Figure 7:
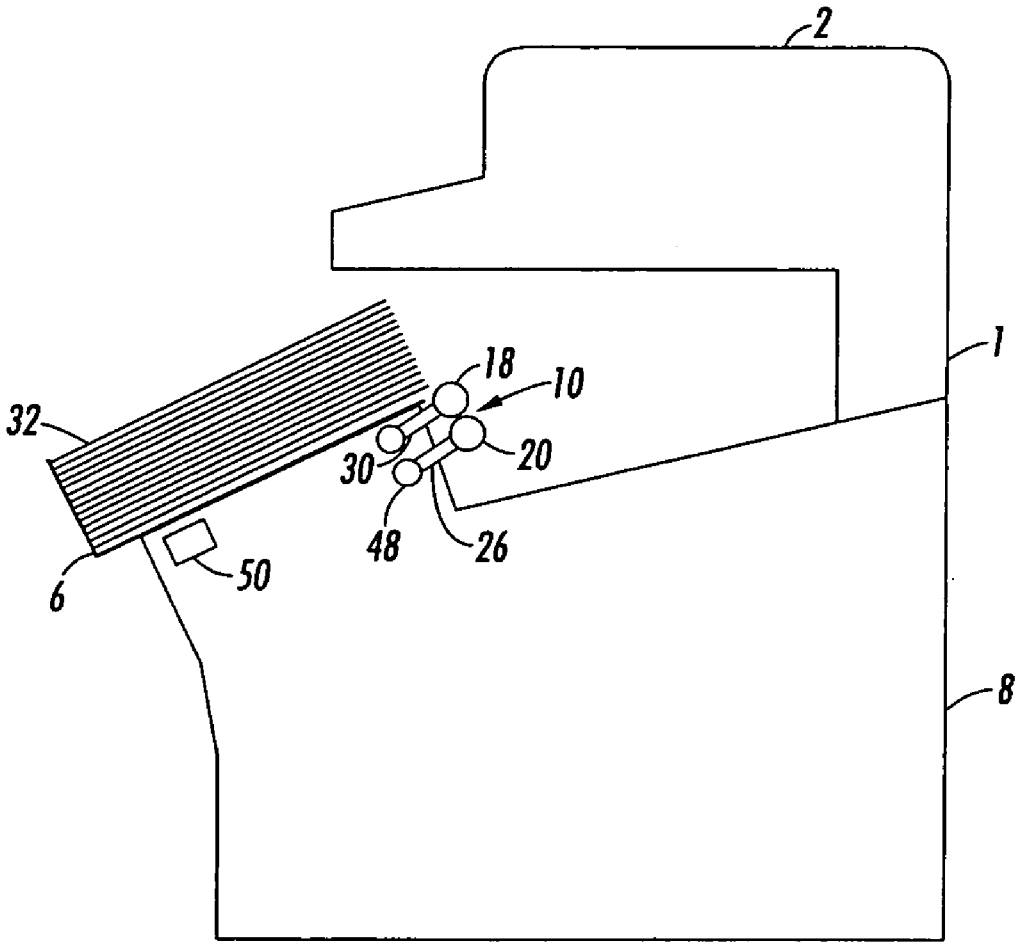
FIG. 7 shows a cross-sectional schematic view of an image formation device including an exemplary media path direction control device.

In an exemplary embodiment, the two pivot arm sets 26, 30 are connected to the motors 12, 14, respectively. The arms 26, 30 are moveable through the elevator motor 12 and the drive motor 14. In an exemplary embodiment, the arms can be of different lengths to establish an optimal trajectory and/or height of the media 32 as the media 32 exits into the paper tray 6 (FIG. 7). In an exemplary embodiment, the elevator motor 12 is controlled to stop arm rotation at various points along a path of travel (Position Two) to complement an increasing (varying) height of a stack of printed media 32 exiting from an print engine 8 into the paper exit tray 6, or for optimal handoff to alternate media paths. In an exemplary embodiment, a sensor system (not shown) determines the approximate height of the existing stack of media and halts operation when the tray 6 is full.

Figure 10:
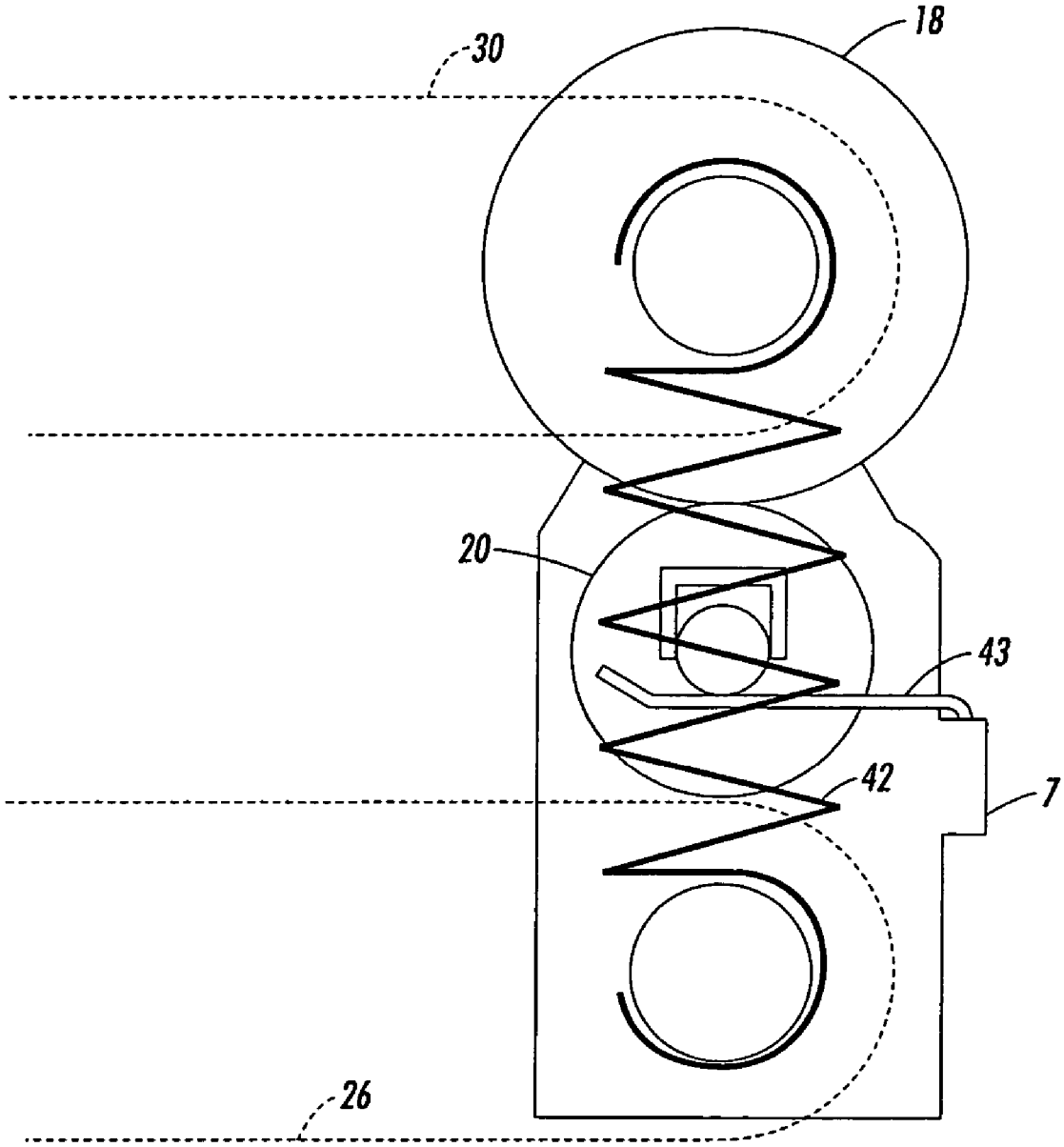
FIG. 10 shows an end-view of a carriage with a spring.

A spring 42 (FIG. 10), is disposed at each end of the carriage 7 coupling the carriage to the upper arm assembly roller shaft 36 to "spring load" the idler rollers 20 against the drive rollers 18. Because the idler rollers 20 of the carriage 7, are individually spring loaded against drive rollers 18, the roller set 18, 20 disposed on the carriage 7, and shaft 36 are held in close contact with one another. Thus, the rollers 18, 20, are free to move with the carriage arms 26, 30 as the carriage arms 26, 30 are driven up and down. In an exemplary embodiment, the idler rollers 20 are also spring loaded so as to be resiliently mounted to the carriage. Idler roller springs 43 would be a commonly used wire form cantilever spring as shown in FIG. 10 to provide such resilience.

Spring loading the carriage 7 provides a convenient way to ensure that the drive rollers 18 follow the carriage 7 through its range of motion. Spring loading each of the idler rollers 20 independently through the idler roller springs 43 ensures that the idler rollers 20 are properly in contact with the drive rollers 18. Spring loading also allows control over the nip 46 formed between the rollers 18, 20. For example, when the upper arms 30 are in their maximum downward pivot position (Position three in FIG. 6), the arms 30 come up against a travel limit stop (not shown). The springs 42 allow the lower arms 26 and the idler rollers 20, of the carriage 7 to continue to move primarily downwardly by overdriving the carriage 7 through the gear rack 24 on the lower arms 26 beyond the limit stop of the upper arms 30 to open up or create a gap between the drive rollers 18 and the idler rollers 20 at the nip 46 (see FIGS. 6 and 8).

The gap between the rollers 18, 20 is created to allow the rollers to separate when media is to be received so that the amount and/or duration of contact between the rollers 18, 20 when receiving the media 32 from the print engine 8 is minimized.

Opening such a gap prevents the media drive system of the print engine 8 from conflicting with the drive systems of the print path media control device 10 (e.g. drive motor 14). In this way almost the entire length of the media 32 travels through the nip 46 with the rollers 18, 20 not in contact with one another. When the media is in the proper position, the elevator motor 12 drives the carriage 7 to an intermediate position (Position one in FIG. 6) clamping the media 32 between the spring loaded rollers 18, 20. The spring loading between these two sets of arms 26, 30 holds the rollers 18, 20 together throughout the rest of the range of movement of the arms 26, 30.

In an exemplary embodiment, during the transfer of media 32 from the print engine to the device 10, carriage 7 is lifted slightly while drive roller 36 is engaged and the rollers 18, 20 grip the media 32 for a brief moment while the media 32 is still in the roller nip of the print engine 8. The media is in the roller nip of the device 10 for only some very small distance. Thus, when both the print engine 8 and the device 10 drive the media together, the trailing edge of that media comes out of the nip from the print engine drive roller to minimize any opportunity for burnishing or wrinkling of the media due to variations or differences in the velocity in the transport systems.

FIG. 7 shows a cross-sectional, schematic view of an image formation device including a diagrammatic representation of an exemplary media path direction control device. As shown in FIG. 7, the image formation device 1 includes a scanner 2, and a print engine 8. The media path direction control device 10 is disposed above the print engine 8 and includes upper and lower parallel arms 26, 30, drive rollers 18 and idler rollers 20. The rollers 18, 20 are connected to the chassis 44 at respective pivot points 48. A controller 50 controls operation of the motors 12, 14 to control movement of the arms 26, 30 and the rollers 18, 20. A plurality of printed media 32 is shown in the paper exit tray 6.

Figure 8:
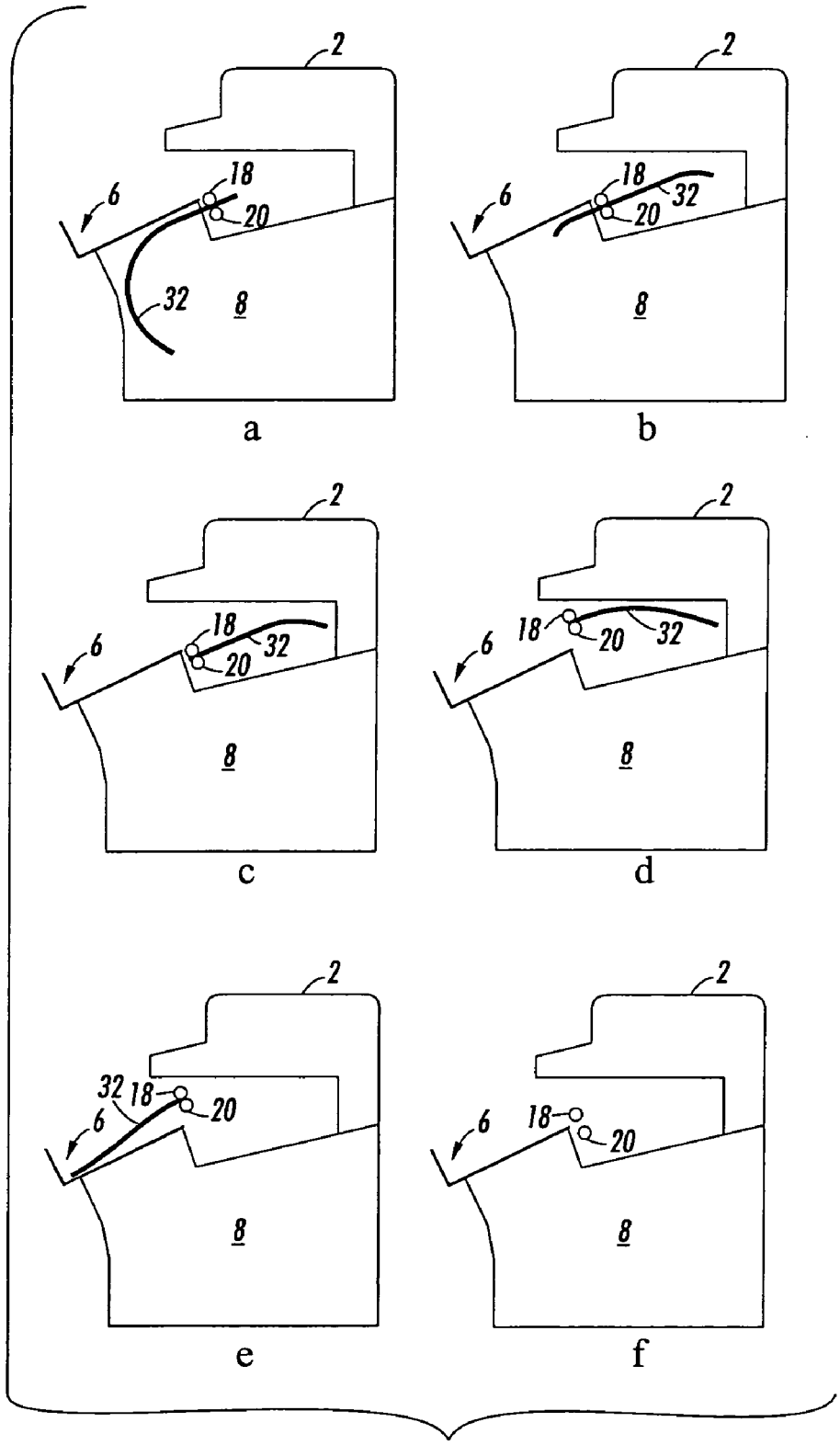
FIG. 8 shows an exemplary series of steps of media path direction control.

FIG. 8 shows an exemplary series of steps in a perspective similar to the image formation device shown in FIG. 7. As shown at step 1 of FIG. 8, drive rollers 18 and idler rollers 20 are in a noncontact, or open, position to receive media 32 exiting the print engine 8. The media 32 is fed out of the print engine 8 through a gap between the rollers 18, 20. Step 2 shows control of the media 32 being handed over from the print engine 8 to the media path direction control device 10. At a predetermined point of the media travel path during handover, the drive rollers 18 and idler rollers 20 are in a contact, or closed, position forming a nip therebetween to capture the media 32. The drive rollers 18 are driven by the drive motor 14 until the media 32 reaches a predetermined position at a trailing edge of the media. At step 3, the media path direction control device 10 detects that the media 32 is at a desired position and the drive motor 14 halts the drive rollers 18. At step 4, the elevator motor 12 rotates the drive gear 34 to drive the gear rack 24 of the lower arms 26 to drive the carriage 7 vertically upward to move the media 32 to a desired position for deposit in the paper exit tray 6. At step 5, upon reaching the desired height, the drive motor 14 is reversed and the media 32, held in the nip 46 formed between the drive rollers 18 and idler rollers 20, cooperatively drives the media 32 out of the nip 46 for deposit into the paper exit tray 6. At step 6, the elevator motor 12 engages the drive gear in a reverse fashion thereby driving the carriage 7 into a lowered position. When moving to a position to receive the next sheet of print media 32, the elevator motor 12 continues to rotate thereby forcing the carriage 7 downward past the travel limit position separating the drive rollers 18 from the idler rollers 20 so as to receive the next sheet of print media 32 from the print engine 8.

Figure 9:
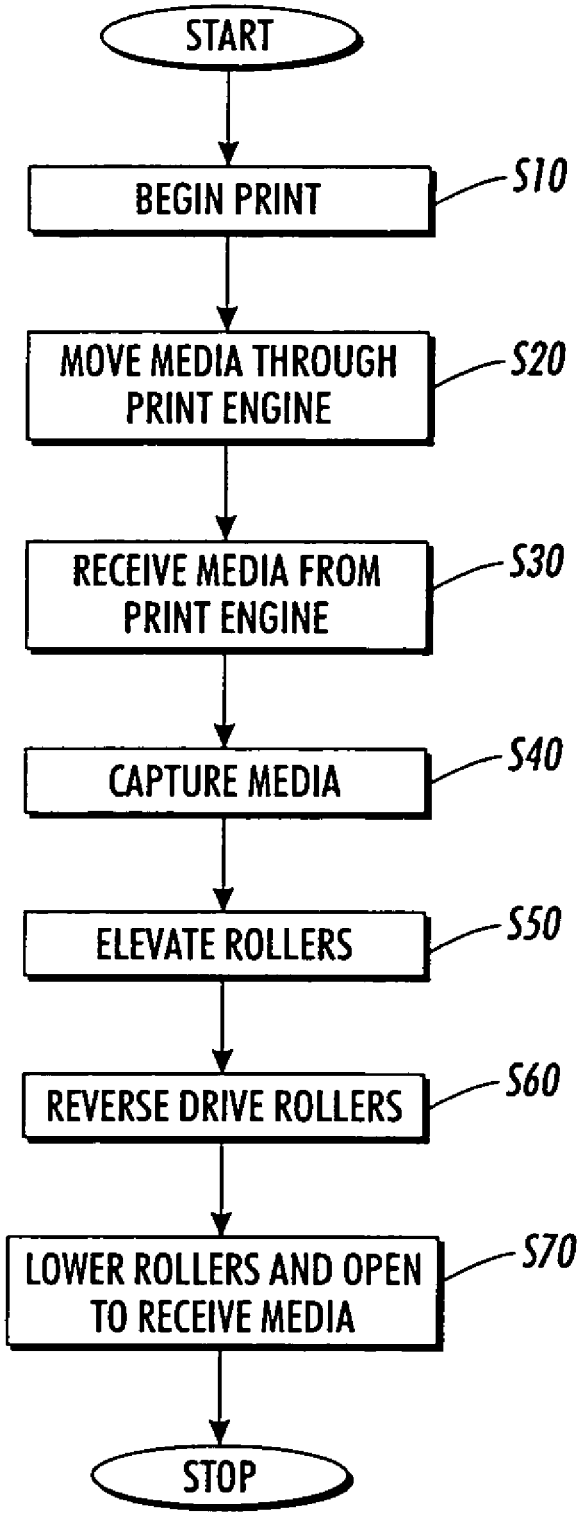
FIG. 9 shows a flowchart of an exemplary series of steps of media path direction control.

FIG. 9 shows a flowchart of an exemplary method of media path direction control, according to an exemplary embodiment of the subject matter of this application. The process begins with the print engine picking a sheet of media and continues to step S10 whereupon printing of the media in the print engine begins. As the media 32 is printed in the print engine 8, the media 32 moves through the print engine 8 to a point of exit at step S20. As the media 32 exits the print engine 8, the media 32 is received by the media print path direction control device 10 at step S30. As the media 32 moves to a desired position in the media print path direction control device 10, the drive rollers 18 and idler rollers 20 of the device 10 to capture the media 32 at step S40. The device 10 then advances the media 32 to a desired position whereas the trailing edge of the media has exited the print engine in step S45. Upon capture and position of the media 32 at a desired position, the media path direction control device 10 elevates the media 32 at step S50 to a desired position. Upon reaching the desired position, the media print path direction control device 10 reverses the drive rollers 18 to eject the media 32 into the paper exit tray 6 at step S60. The rollers are then positioned to receive the next piece of print media 32 from the print engine 8 at step S70.

Although this invention has been described in conjunction with the exemplary embodiments outlined above, various alternatives, modifications, variations, improvements, and/or substantial equivalents, whether known or that are or may be presently unforeseen, may become apparent upon reviewing the foregoing disclosure. Accordingly, the exemplary embodiments of the invention, as set forth above, are intended to be illustrative, not limiting. Various changes may be made without departing from the spirit and scope the invention.

What is claimed is:

1. A media path control device for changing a travel path of media in an image formation device from a first plane to a second plane, the media path control device comprising:

a first set of arms connected to a carriage and rotatable about a pivot point;

a second set of arms connected to the carriage and rotatable about a pivot point;

at least one drive roller connected to the first set of arms, the at least one drive roller being driven by a first driving device, the at least one drive roller and the carriage being moveable through a desired plane substantially perpendicular to the first plane and the second plane of travel with the second set of arms;

at least one passive roller connected to the second set of arms and disposed on the carriage opposite the at least one drive roller to form a nip therebetween, the at least one passive roller and the carriage being moveable through the desired plane substantially perpendicular to the first plane and the second plane of travel with the first set of arms; and a second driving device connected to the second set of arms to move the carriage through the desired plane perpendicular to the first plane and the second plane of travel.

2. The device of claim 1, wherein at least one of the first driving device and the second driving device is reversible to control directional movement of media received from the image formation device.

3. The device of claim 2, wherein the desired plane is a substantially vertical plane relative to the directional movement of media received from the image formation device.

4. The device of claim 1, further comprising a first drive belt connected to the first driving device and the at least one drive roller to impart a driving force to the at least one drive roller.

5. The device of claim 1, further comprising a second drive belt connected to the second driving device and the second set of arms to impart a driving force to the second set of arms and the carriage.

6. The device of claim 1, wherein the at least one drive roller and the at least one passive roller are in elastic contact with one another.

7. The device of claim 1, wherein the second set of arms are rotatably driven in a primarily vertically downward direction by the second driving device thereby opening a gap between the at least one drive roller and the at least one passive roller disposed on the carriage to receive media from the image formation device.

8. The device of claim 7, wherein the gap between the at least one drive roller and the at least one passive roller is closed by elastic tension to capture media received from the image formation device.

9. The device of claim 1, wherein the second set of arms are rotatably driven in a primarily vertically upward direction by the second driving device to move the carriage through the desired plane and the first driving device drives the at least one drive roller to discharge media received from the image formation device.

10. The device of claim 1, wherein the pivot point of the first set of arms is spaced from the pivot point of the second set of arms.

11. The device of claim 1, wherein the first set of arms and the second set of arms are parallel.

12. A media path control device for an image formation device, the media path direction control device comprising a controller that:

moves a carriage having at least one drive roller and at least one passive roller disposed opposite the at least one drive roller to a first position to receive media from the image formation device along a first path of travel;

drives the carriage past a first stop point to open a gap between the at least one drive roller and at least one passive roller to allow the media to pass therebetween;

closes the gap between the at least one drive roller and at least one passive roller to capture the media at a nip formed therebetween;

moves the carriage and the captured media to a second position relative to the first position; and rotates the at least one drive roller to transport the captured media out of the nip to a second path of travel.

13. A method of controlling media path direction in an image formation device, the method comprising:

receiving media from a first plane of travel in a gap formed between at least one drive roller and at least one passive roller;

capturing the media in a nip formed between the at least one drive roller and the at least one passive roller;

moving the media to a second plane of travel; and driving the media into the second plane of travel, wherein moving the media includes driving the at least one drive roller and the at least one passive roller in a direction perpendicular to the first and second planes of travel.

14. The method of claim 13, wherein driving the media into the second plane of travel includes moving the media in a reverse direction.

15. The method of claim 13, further comprising stopping the moving of the media at a predetermined position.

16. A media path control device for changing a travel path of media in an image formation device from a first plane to a second plane, the media path control device comprising:

a rotatable shaft connected to a first set of arms which are rotatable about a pivot point;

a roller carrier connected to a second set of arms which are rotatable about a pivot point;

a connection disposed between the first set of rotatable arms and the second set of rotatable arms such that rotating one arm set causes the other arm set to rotate;

at least one drive roller mounted on the rotatable shaft, the at least one drive roller being driven by a first driving device, the at least one drive roller being moveable through an arc to move from a first position to a second position;

at least one passive roller connected to the roller carrier and disposed opposite the at least one drive roller to form a nip therebetween, the at least one passive roller and the roller carrier being moveable through an arc from a first position to a second position; and a second driving device connected to the second set of arms to move the carrier from the first plane created at the nip of the rollers in the first position to the second plane offset from the first plane.

17. The device of claim 16, wherein the second set of arms are rotatably driven by the second driving device to a position beyond a travel limit of the first set of arms, thereby opening a gap between the at least one drive roller and the at least one passive roller disposed on the roller carrier to receive media from the image formation device.

18. The device of claim 16, wherein the second set of arms are rotatably driven by the second driving device to move the arms and the roller nip into a desired plane of the second position and the first driving device drives the at least one drive roller to discharge media received into the roller nip from a desired plane of the first position.

19. The device of claim 16, wherein the pivot point of the first set of arms is offset from the pivot point of the second set of arms.

20. The device of claim 16, wherein the pivot point of the first set of arms is in-line with the pivot point of the second set of arms.

21. The device of claim 16, wherein the length of the first set of anns is equal to the length of the second set of arms.

22. The device of claim 16, wherein the length of the first set of arms is unequal to the length of the second set of arms.

* * * * *